US007145066B1

(12) United States Patent
Moreland

(10) Patent No.: US 7,145,066 B1
(45) Date of Patent: Dec. 5, 2006

(54) STRINGED INSTRUMENT PICK GRIP

(76) Inventor: R. Payson Moreland, 1550 N. Elm, Ottumwa, IA (US) 52501

( * ) Notice: Subject to any disclaimer, the term of this patent is extended or adjusted under 35 U.S.C. 154(b) by 14 days.

(21) Appl. No.: 10/822,902

(22) Filed: Apr. 13, 2004

Related U.S. Application Data

(60) Provisional application No. 60/462,665, filed on Apr. 14, 2003.

(51) Int. Cl.
*G10D 3/16* (2006.01)

(52) U.S. Cl. ..... 84/320

(58) Field of Classification Search ..... 84/320–322
See application file for complete search history.

(56) References Cited

U.S. PATENT DOCUMENTS

| | | | | |
|---|---|---|---|---|
| 4,137,814 A | | 2/1979 | Rowley | |
| 4,993,302 A | * | 2/1991 | Jonathan | 84/322 |
| 5,341,715 A | | 8/1994 | Hucek | |
| 6,040,512 A | * | 3/2000 | Polley | 84/322 |
| 6,054,643 A | | 4/2000 | Chance et al. | |
| 6,130,374 A | | 10/2000 | Polidori | |
| 6,417,431 B1 | | 7/2002 | Wilkinson | |
| 2002/0108483 A1 | * | 8/2002 | Smith | 84/322 |
| 2002/0178891 A1 | * | 12/2002 | Atkin | 84/322 |

* cited by examiner

*Primary Examiner*—Kimberly Lockett
(74) *Attorney, Agent, or Firm*—McKee, Voorhees & Sease, P.L.C.

(57) ABSTRACT

An apparatus to improve gripability of stringed instrument picks which have a gripping portion on a first surface, including a material that is appliable to the gripping portion, and the material having properties that resist sliding and promotes gripability by human fingers. In one aspect of the invention, the material can be removable and reappliable by cohesive resurface tension forces. Optionally the material can be applied to another gripping portion on another surface of the pick.

26 Claims, 3 Drawing Sheets

STRINGED INSTRUMENT PICK GRIP

I. CROSS REFERENCE TO RELATED APPLICATIONS

This application is a Nonprovisonal Application of U.S. Patent Application No. 60/462,665 filed on Apr. 14, 2003, the contents of which are hereby incorporated by reference in their entirety.

II. BACKGROUND OF THE INVENTION

A. Field of the Invention

The present invention relates to picks for stringed instruments of virtually any type, and in particular, a grip apparatus, method, and system to improve a user's grip of such picks.

B. Problems in the Art

A variety of stringed instruments are played with a pick. Some picks are planar, relatively small members approximately 1 inch wide and 1 inch in length and fraction of an inch thick. One portion of the pick is usually tapered to a general point. These picks have some resiliency, but are substantially rigid. The pick's opposite flat sides are gripped between the fingers of one hand (e.g. thumb and fore finger). Such picks are well known in the art, and are typically called "flat picks". Another type of stringed instrument pick is commonly called a finger pick. It has a hooked distal end and receiver for an individual finger. A set of finger picks for a user's hand are usually used. This invention applies primarily to the former type of pick, the flat pick.

As used herein, the term "pick" refers to any type of stringed instrument pick that is gripped by or between, or applied to, or mounted on fingers unless otherwise indicated. Such a pick (e.g. somewhat resilient, rigid, and durable) usually has hard, non-porous surfaces. And essentially the surfaces are smooth. Because of this, such a pick can slide or slip on or between the user's fingers. This is especially true if perspiration, oil, or other substances get onto the pick. Of course, slippage can affect play of the instrument, and indeed, performance. But also, the relatively small size of such picks can result in loss of the pick or dropping it to the ground which, at a minimum, can cause interruption of play or worse. On non-solid body instruments, picks are sometimes dropped and fall inside the instrument. For these reasons, many players, particularly during public performances, have to carry multiple picks in case one is dropped or lost.

I have therefore identified a need for improvement in the art. A general object, feature, advantage, or aspect of the present invention is a device, a system, and a method for making the same, that can improve grip of a stringed instrument pick. Further objects, features, advantages or aspects of the invention include a device which:

1. does not materially affect the nature or characteristics of the pick.
2. is economical to make and purchase.
3. does not substantially change the dimensions of a conventional pick.
4. is durable.
5. can be mass-produced.
6. is easy to use.
7. is easy to implement, including retrofitting existing picks and essentially integrating into them.
8. can promote improved playing of the instrument.
9. is flexible and useable with a variety of styles of picks.

Guitar players and other stringed instrument players have long tried various things to be able to hold onto their picks more efficiently. Losing the grip on the pick while playing compromises the player's ability as well as tone of their playing. Various flat picks with raised bumps or ridges, or holes in them have been tried. There is a tacky paste ("Gorilla Snot" trade name, for example) that can be rubbed on to the pick as well. There is not, to my knowledge or searching, any simple, non-messy, inexpensive device that can be used with existing picks.

As mentioned, the problem was addressed in the past by trying such things as (a) various pick materials, such as plastic, metal, stone, etc., (b) raised ridges on pick surface, (c) a hole in the pick, or (d) by a tacky paste in a jar that can be rubbed onto pick (Gorilla Snot™). Alternatively or in addition, players would have multiple picks in pick holder on the instrument or microphone stand so they could quickly obtain another pick when they dropped the one they were using. Most ideas for improving grip involved having to buy another pick to try to get a better grip so existing picks would not be used or thrown away.

Some attempts to address either this exact problem in the art, or try to improve picks for other reasons, are disclosed in several patents. However, it is not believed that any of these attempts provide features, advantages, or aspects of the present invention.

U.S. Pat. No. 4,137,814 discloses a palm piece attached to the user's hand with a flexible member (e.g. a chain) to the pick.

U.S. Pat. No. 4,993,302 discloses a soft, flexible piece that is adhesively attached to a side of a conventional pick. It also discloses that an adhesive is spread over the soft flexible member once adhered to the pick to provide extra tackiness to improve the grip.

U.S. Pat. No. 5,341,715 discloses raised ledges at acute angles on a side of the pick for assistance in gripping.

U.S. Pat. No. 6,054,643 discloses a curved portion making a finger cradle to improve the ergonomic characteristics of a pick. It alleges less gripping pressure is needed to hold onto the pick, and that this is possible by the 3-dimentional characteristics of the curved portion or finger cradle.

U.S. Pat. No. 6,130,374 discloses cavities in a frustoconical, 3-dimentional pick with angled tips and grooves.

U.S. Pat. No. 6,417,431 discloses protrusions and a beveled region to improve grip.

Despite all these attempts, it is believed that room for improvement exists in the art.

III. SUMMARY OF THE INVENTION

My invention is inexpensive, and can be placed on any existing pick. Experimental playing with the device by professional musicians has resulted in them reporting a great improvement in their playability as well as confidence in that they report this is the best gripping device they have ever tried and they can use it on their favorite picks they already own. They have described an improvement in their playing of 10% to 15%.

The present invention relates in one aspect to an apparatus for application to a gripping portion on a first surface of a stringed instrument pick, the apparatus comprising a thin piece of material promoting gripping by human fingers.

Additional objects, features, advantages, and aspects of the invention will become more apparent with reference to the accompanying specification and claims, including appended drawings.

IV. BRIEF DESCRIPTION OF THE DRAWINGS

V. DETAILED DESCRIPTION OF EXEMPLARY EMBODIMENTS

Figure 1:
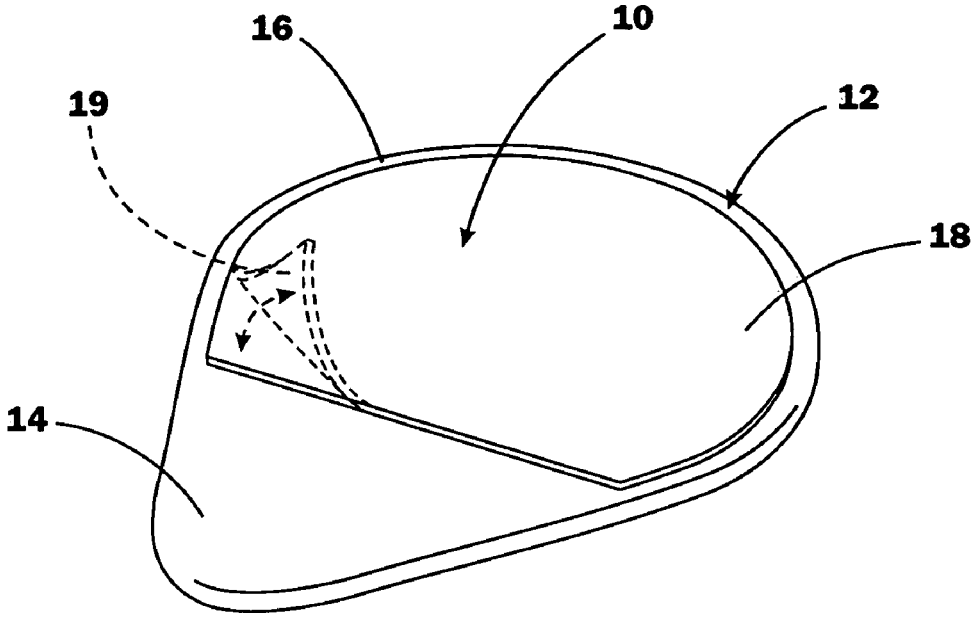
FIG. 1 is an enlarged perspective illustration of an exemplary embodiment of the invention installed on a conventional stringed instrument pick.

For a better understanding of the invention, one form the invention can take will now be described in detail. This description is for illustration only and not to limit the invention. Variations obvious to those skilled in the art will be included with in the invention.

Reference will be taken to the accompanying drawings which were previously summarized. Reference numbers will be used to indicate certain parts and locations in the drawings. The same reference numbers and letters will be used to indicate the same parts and locations throughout the drawings unless otherwise indicated.

Figure 2:
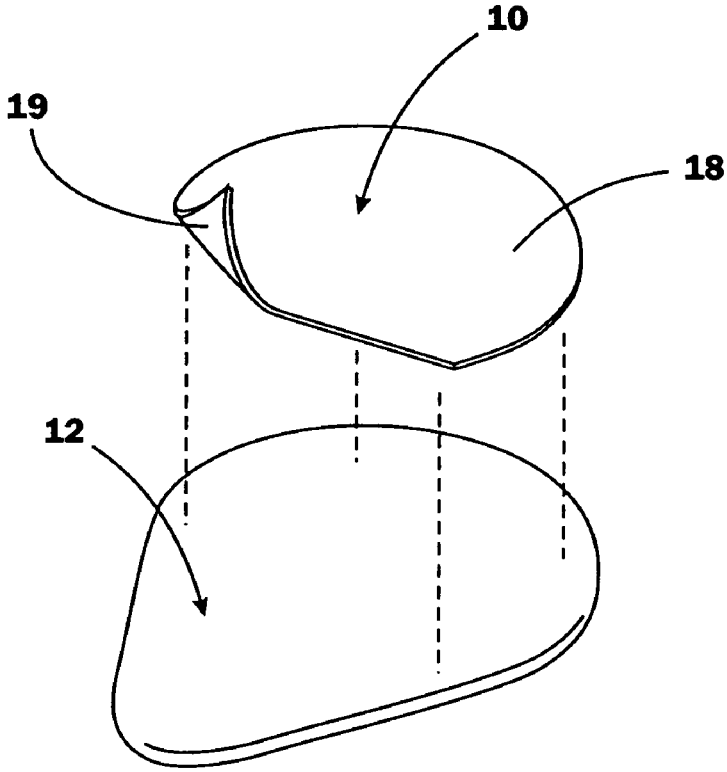
FIG. 2 is a reduced in size version of FIG. 1 showing the exemplary embodiment of the invention of FIG. 1 in exploded form relative to a conventional pick.

FIGS. 1 and 2 illustrate a conventional stringed instrument flat pick 12. This type of pick is illustrated in several of the U.S. patents discussed in the background of the invention. The disclosures of such patents are incorporated by reference herein in their entirety, as background information. FIG. 1 illustrates grip 10 installed on a generally flat, planar surface of pick 14.

Figure 5:
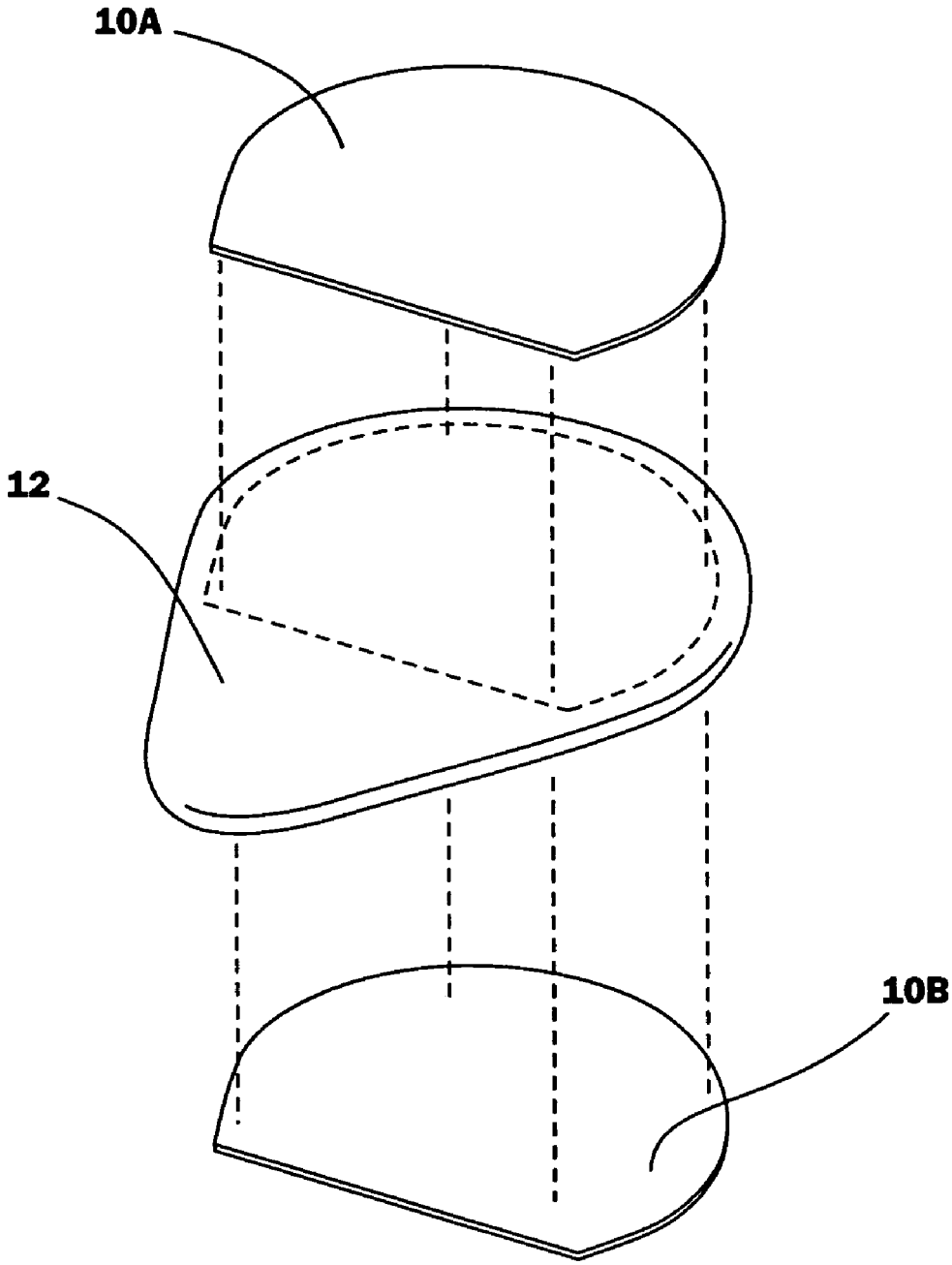
FIG. 5 is similar to FIG. 2 but shows an alternative exemplary embodiment of the invention with grip member attachable to both sides of the pick.

This grip 10 is a thin, rubber-type device in the shape of the upper half of a stringed instrument pick 12 (the part gripped by fingers and thumb). One side 19 of device 10 is very smooth, which is the side that is adhered to the pick surface 16 (one side of pick 12). One side 18 is slightly rough for gripping with your finger(s) and/or thumb. The device 10 may be placed on one side (See FIG. 1) or both sides of the pick 12 (see FIG. 5—a device 10A on one gripping portion of a first side or surface of pick 12, and a second device 10B on a gripping portion of a second side of pick 12).

Figure 3:
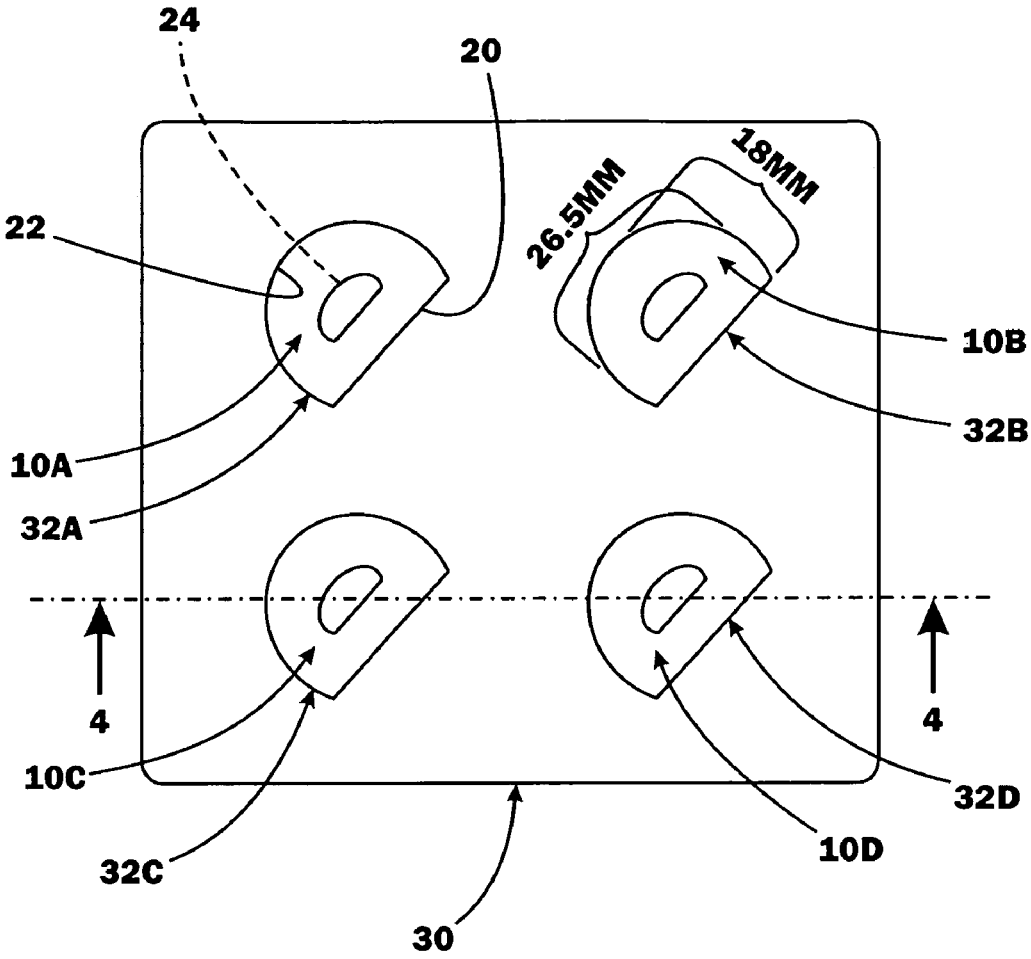
FIG. 3 is a top plan view of a mold used in forming one or more of the exemplary embodiments shown in FIGS. 1 and 2.

The device 10 can be made from liquid silicon or liquid plastic or liquid latex, similar to Toymax plasticgoop for Creepy Crawlers, which is molded. Other materials are, of course, possible. The mold 30 (See FIG. 3) can be made from steel or similarly hard non-stick material capable of withstanding repeated heat of temperatures up to 700° F. The mold 30 is one-sided (not injection) such that there is a shallow depression 32 in the steel (0.6 mm to 1.0 mm) in the general shape of a trapezoid with rounded corners at the widest point (See FIG. 3). There can be a small oval depression 24 (see also FIG. 4) in the center of this that is approximately 0.01 mm to 0.03 mm deeper so that the resulting device 10 has a slight raised portion. This can be optional to produce enhanced texture or gripping. The depression 32 is 26.5 mm wide at it widest point and 18 mm in length. This allows for a large gripping area that can later be modified by the player if desired. The bottom face of each depression 32 of mold 30 can be slightly roughened or mottled to form the side 18 of the device for gripping. Liquid material as described above is poured into the mold 30 and allowed to level. This top or exposed side forms the smooth surface 19 of the device for adherence to the pick (this is why injection molding may not be as good, it does not allow for as smooth a surface for adhering to the pick surface without slipping). The mold 30 is placed into a heated area (oven or kiln) at 475° for eight minutes and then allowed to cool at room temperature, 66° to 75° F., for four to six minutes. Heating time and temperature may be varied, but this is optimum.

Device 10 adheres to the pick 12 by the natural tackiness of the device, the ultra light weight of the device, and cohesive frictional forces and/or surface tension. The pick grip 10 can be removed and re-adhered multiple times to different picks 12, placed on one or both sides of the pick 12 and even stacked more than one thick, if desired. The device 10 is roughly large enough to cover about 60% of a standard size pick 12, but can be trimmed or modified with standard household scissors to the player's desired size. It can be applied to virtually all known pick materials on the market as well as future materials. Device 10 can be varied in thickness from 0.6 mm to 1.0 mm based on volume of liquid material poured into mold 30.

It can therefore be seen that grip 10 can be made in mass-produced form of economical material. It utilizes surface tension and other properties of the material to adhere to the side of pick 12. However, it can be easily removed and stored in a user's pocket. It, therefore, can be reused or removed and replaced. It can also be retrofitted onto any number of existing picks.

Futhermore, it does not change the essential nature of the conventional pick 12. It does not substantially change its dimensional shape. It also does not substantially change its functional operation.

As can be appreciated, therefore, advantages of my invention include that it is inexpensive, it can be used with existing picks, and it can improve playing and confidence over existing devices in that the player can customize it to their particular pick and playing preferences. Existing picks with integrated gripping devices require the player to hold the pick where the grip is integrated into the pick and not necessarily where the player prefers.

Use of this device is for professional and hobby, as well as beginner stringed instrument players. It will let them grip their pick without fear of slipping or dropping it, thereby letting them concentrate on the playing. They may use the device in the position they choose to hold the pick and not a pre-designed position.

Options and Alternatives

It will be appreciated that the foregoing exemplary embodiment is but one way the invention can be made and embodied. Variations in shape, dimensions, materials, and manufacturing methods are included within the invention. The invention includes basic characteristics of an economical, reasonably durable, mass-producible device that materially increases grippability of the pick. As mentioned, it could be applied to one side of the pick. Alternatively, two grips can be placed on grip 12, one on each side.

It is possible that the same concept could be utilized for other types of picks, and perhaps even finger picks, to deter sliding of the finger pick on the finger.

Figure 4:
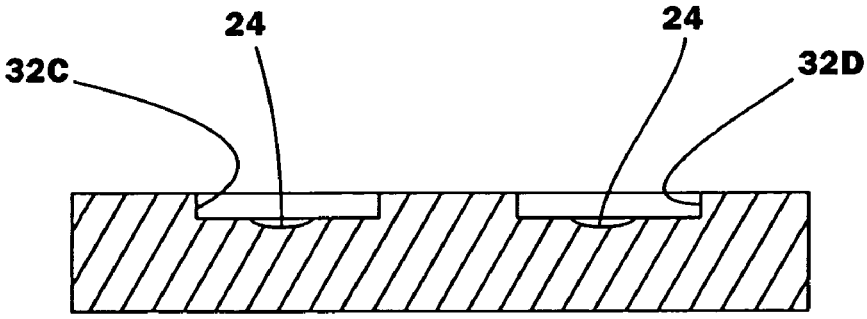
FIG. 4 is a sectional view of just the mold of FIG. 3, taken along line 4—4 of FIG. 3.

And, of course, larger scale, mass-production could be utilized such as are well known in the art. FIG. 4 illustrates up to four devices 10 can be molded simultaneously. Larger scale molds (for larger simultaneous molding of multiple device 10) are possible. Other production methods are possible.

It is not necessarily required that there be any sort of texturing of the outer surface of grip 10 or the oval-shaped projection be used. It can be produced by various methods.

Still further, the ability to remove grip 10 includes the advantage that once removed, there is no residue or remnant of grip 10 left on pick 12. Pick 12 returns to essentially its original form.

What is claimed is:

1. A removable and repeatably reusable apparatus for use with and to improve grippability by a user's fingers of a stringed instrument pick comprising:

a) a relatively thin piece of material having a perimeter, opposite sides, and the following inherent properties:
   (i) resists sliding of human fingers;
   (ii) is repeatably applicable to and removable from a surface of one or more picks;
   (iii) resists sliding or separation when applied to a surface of a pick;
   (iv) does not leave a substantial residue or remnant on a user's fingers or on a pick;

b) so that the piece can improve grip of a pick by a user, is not permanently attached to a pick, and does not require a separate adhesive or mounting structure to a pick or a user.

2. The apparatus of claim 1 wherein the removable adhesion is by cohesion and/or surface tension.

3. The apparatus of claim 2 wherein the cohesion is without residue if removed.

4. The apparatus of claim 1 wherein the material is adapted to be sized and shaped so that it does not substantially change the size, shape, mass, or function of a pick.

5. The apparatus of claim 1 wherein the material is sized and shaped to fit within perimeter dimensions of a pick.

6. The apparatus of claim 1 wherein the material can be retrofitted to an existing pick.

7. The apparatus of claim 1 wherein the material is adaptable to a variety of sizes and shapes of picks.

8. The apparatus of claim 1 wherein the material is rubbery-like having a substantially tacky exterior and is flexible.

9. The apparatus of claim 1 wherein the material is made from liquid silicon, liquid plastic, or liquid latex.

10. The apparatus of claim 1 wherein the material is moldable.

11. The apparatus of claim 1 wherein one side of the material is smooth.

12. The apparatus of claim 11 wherein the other side of the material has some texture, is roughened, or is mottled.

13. The apparatus of claim 1 wherein the material has a central thickness variance.

14. The apparatus of claim 13 wherein the central thickness variance is either a raised portion or a depression.

15. The apparatus of claim 1 wherein the material has a thickness on the order of or less than the thickness of a pick to which it is to be applied.

16. The apparatus of claim 15 wherein the thickness of the material is approximately from 0.6 mm to 1.0 mm.

17. The apparatus of claim 1 wherein the perimeter dimensions of the material include approximately 26.5 mm at its widest and 18 mm in length.

18. The apparatus of claim 1 further comprising a second piece of material adapted for application to a gripping portion on a second surface of a pick.

19. The apparatus of claim 1 in combination with a stringed instrument pick.

20. A stringed instrument pick system comprising:

a) a stringed instrument pick having a gripping portion on a first surface;

b) a relatively thin piece of material which, by inherent properties of the material, is repeatably applicable to and removable from the gripping portion, resists sliding or separation, and promotes grip by human fingers when removably applied to said gripping portion on said first surface of the pick, but does not leave a substantial residue or remnant on a user's fingers or on a pick; so that the piece can improve grip of a pick by a user, is not permanently attached to the pick, and does not require a separate adhesive or mounting structure to the pick or the user.

21. The system of claim 20 further comprising a relatively thin piece of material which resists sliding, promotes grip of human fingers appliable to a gripping portion on a second surface of the pick.

22. The system of claim 20 wherein the material is shaped to fit within perimeter dimensions of the first surface of the pick.

23. A method of improving grippability of a stringed instrument pick comprising:

a) applying a material to a gripping portion on a first surface of the pick, the material being relatively thin, and having inherent properties comprising resists sliding or separation and promotes gripping by human fingers when applied to a surface of a pick, is repeatably appliable to and removable from a pick but does not leave a substantial residue or remnant on a user's fingers or on a pick, and shaped and sized to fit within perimeter dimensions of the pick;

b) gripping the pick with at least one finger in contact with the material applied on the gripping portion of the first surface.

24. The method of claim 23 wherein the material does not materially affect size, shape, mass, function or pliability of the pick.

25. A method of making an apparatus for use with a stringed instrument pick to increase grippability of the pick comprising:

a) forming a mold having a shape which roughly approximates the shape of the gripping portion of a stringed instrument pick;

b) placing into the mold a liquid material, the liquid material being formed of liquid silicone, plastic, or latex;

c) heating the material in the mold at approximately 470° F. for approximately 8 minutes;

d) cooling the material in the mold at approximately 66 to 75° F. for approximately 4 to 6 minutes;

e) removing the material from the mold.

26. A removable and repeatably reusable apparatus for use with and to improve grippability by a user's fingers of a stringed instrument pick having comprising:

a) a piece of material having a perimeter, opposite sides, and the following inherent properties:

(i) resists sliding of human fingers along at least one of the opposite sides;

(ii) is repeatably applicable to and removable from a surface of one or more stringed instrument picks; and (iii) resists sliding or separation when applied to a surface of a pick;

(iv) does not leave a substantial residue or remnant on a user's fingers or on a pick;

so that the piece can improve grip of a pick by a user, is not permanently attached to a pick, and does not require a separate adhesive or mounting structure to a pick or a user.

* * * * *